US008247726B2

(12) United States Patent
Prohaska et al.

(10) Patent No.: US 8,247,726 B2
(45) Date of Patent: Aug. 21, 2012

(54) ELECTRICAL SWITCHING APPARATUS AND ARC CHUTE ASSEMBLY THEREFOR

(75) Inventors: Richard D. Prohaska, Cleveland, TN (US); Jeffrey B. Ensley, Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 479 days.

(21) Appl. No.: 12/507,117

(22) Filed: Jul. 22, 2009

(65) Prior Publication Data

US 2011/0017709 A1 Jan. 27, 2011

(51) Int. Cl.
*H01H 33/02* (2006.01)

(52) U.S. Cl. ..... 218/149; 218/157; 218/34

(58) Field of Classification Search ..... 218/15, 218/34–41, 147–151, 156–158; 335/201, 335/202

See application file for complete search history.

(56) References Cited

U.S. PATENT DOCUMENTS

| | | | |
|---|---|---|---|
| 2,644,048 | A | 6/1953 | Frink et al. |
| 3,440,378 | A | 4/1969 | Baird |
| 3,662,133 | A | 5/1972 | Bould et al. |
| 3,728,503 | A | 4/1973 | Clausing et al. |
| 3,749,867 | A | 7/1973 | Rexroad |
| 3,784,775 | A | 1/1974 | Gryctko |
| 3,997,746 | A | 12/1976 | Harper et al. |
| 4,217,472 | A | 8/1980 | Gryctko et al. |
| 4,370,634 | A | 1/1983 | Kondo et al. |
| 4,375,021 | A | 2/1983 | Pardini et al. |
| 4,453,055 | A | 6/1984 | Berrios et al. |
| 4,480,161 | A | 10/1984 | Kellogg et al. |
| 4,511,772 | A | 4/1985 | Link et al. |
| 4,612,426 | A | 9/1986 | Maier et al. |
| 4,689,546 | A | 8/1987 | Stephens et al. |
| 4,737,606 | A | 4/1988 | Winter |
| 4,748,301 | A | 5/1988 | Goldman et al. |
| 4,877,929 | A | 10/1989 | Rival |
| 4,950,852 | A | 8/1990 | Goldman et al. |
| 4,973,805 | A | 11/1990 | Paton et al. |
| 4,975,553 | A | 12/1990 | Oster |

(Continued)

FOREIGN PATENT DOCUMENTS

| | | |
|---|---|---|
| DE | 76 08 130 | 7/1976 |

(Continued)

OTHER PUBLICATIONS

European Patent Office, "extended European search report", Mar. 5, 2012, 9 pp.

*Primary Examiner* — Amy Cohen Johnson
*Assistant Examiner* — Marina Fishman
(74) *Attorney, Agent, or Firm* — Dawn C Wolff; Martin J. Muran

(57) ABSTRACT

An arc chute assembly is provided for an electrical switching apparatus. The electrical switching apparatus includes a housing and separable contacts enclosed by the housing. An arc is generated in response to the separable contacts being separated. The housing includes a number of arc chambers each having a first side and a second side disposed opposite and spaced apart from the first side. The arc chute assembly includes a plurality of first arc plates extending outwardly from the first side of a corresponding one of the arc chambers toward the second side of the corresponding one of the arc chambers, and a plurality of second arc plates extending outwardly from the second side of the corresponding one of the arc chambers toward the first side of the arc chamber. None of the arc plates engages the opposing side of the arc chamber.

16 Claims, 3 Drawing Sheets

U.S. PATENT DOCUMENTS

| | | | |
|---|---|---|---|
| 5,004,874 | A | 4/1991 | Theisen et al. |
| 5,130,504 | A | 7/1992 | Moldovan et al. |
| 5,247,142 | A | 9/1993 | Yonkovitz et al. |
| 5,498,847 | A | 3/1996 | Bennett et al. |
| 5,504,292 | A | 4/1996 | Bennett et al. |
| 5,569,894 | A | 10/1996 | Uchida et al. |
| 5,589,672 | A | 12/1996 | Uchida et al. |
| 5,834,724 | A | 11/1998 | Asakawa et al. |
| 5,861,596 | A | 1/1999 | Grass et al. |
| 5,877,467 | A | 3/1999 | Arnold et al. |
| 6,248,970 | B1 | 6/2001 | DiMarco et al. |
| 6,297,465 | B1 | 10/2001 | Groves et al. |
| 6,624,373 | B2 | 9/2003 | Raabe et al. |
| 6,703,576 | B1 | 3/2004 | Chou et al. |
| 6,794,595 | B2 | 9/2004 | Charles et al. |
| 6,825,431 | B2 | 11/2004 | Azzola et al. |
| 7,034,242 | B1 | 4/2006 | Shea et al. |
| 7,094,986 | B2 | 8/2006 | Shea |
| 7,521,645 | B2 | 4/2009 | Shea et al. |
| 2003/0000925 | A1 | 1/2003 | Azzola et al. |

FOREIGN PATENT DOCUMENTS

| | | |
|---|---|---|
| GB | 1574886 | 9/1980 |
| JP | 57 076344 | 5/1982 |
| JP | 20070149486 | 6/2007 |

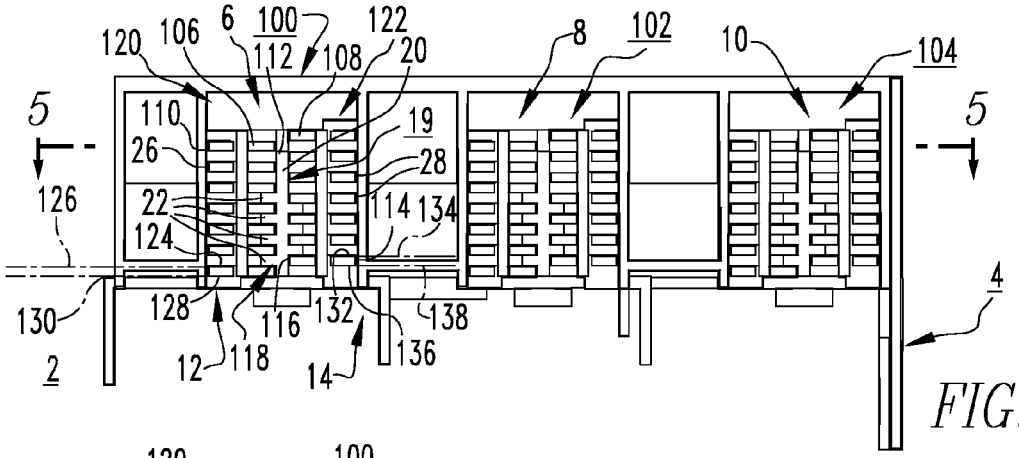
FIG.4
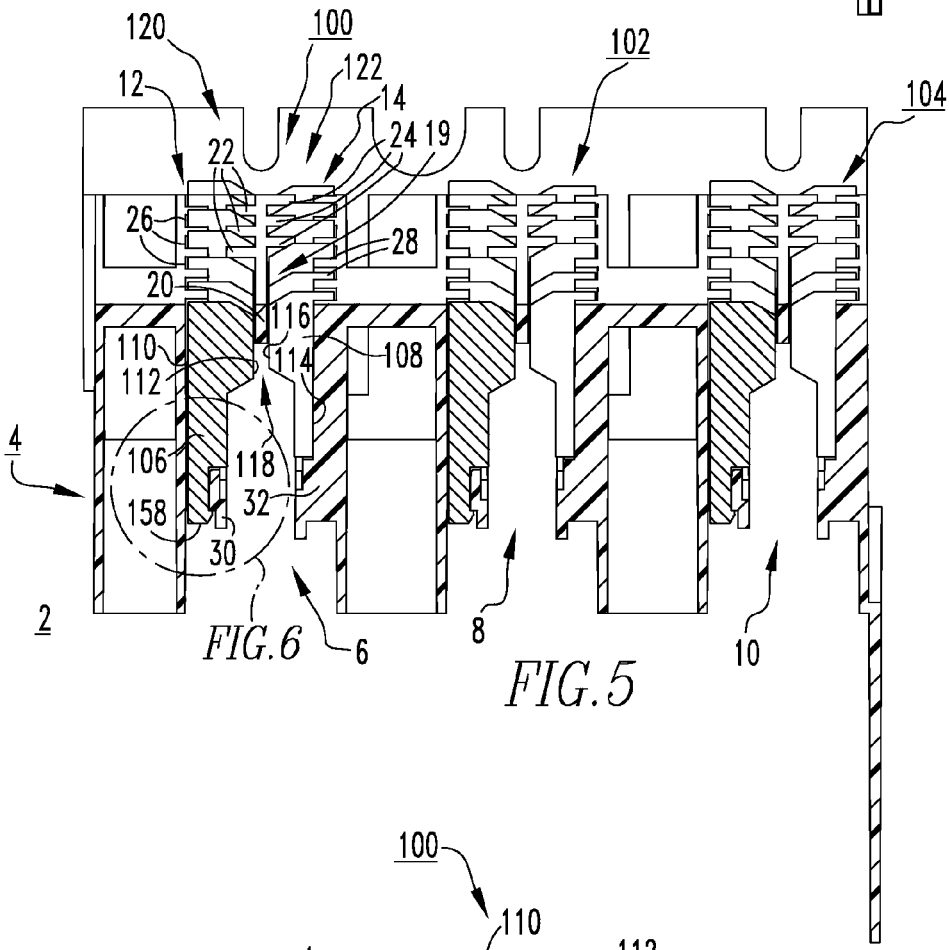
FIG.6
FIG.5
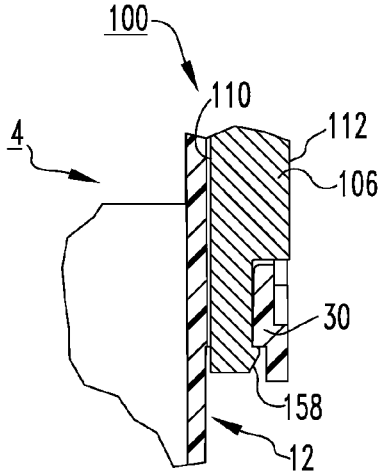
FIG.6

ELECTRICAL SWITCHING APPARATUS AND ARC CHUTE ASSEMBLY THEREFOR

BACKGROUND

1. Field

The disclosed concept relates generally to electrical switching apparatus and, more particularly, to arc chute assemblies for electrical switching apparatus.

2. Background Information

Electrical switching apparatus, (e.g., without limitation, circuit switching devices, such as switches with and without fuses, and other circuit interrupters, such as circuit breakers, contactors, motor starters, motor controllers and other load controllers) typically include separable electrical contacts that are movable into and out of physical and electrical contact with one another when it is desired to energize and disconnect, respectively, a power circuit. That is, when it is desired to interrupt the power circuit, the separable electrical contacts are separated. Upon initial separation, an electrical arc is formed in the space between the contacts. The arc provides a means for smoothly transitioning from a closed circuit to an open circuit, but produces a number of challenges to the electrical switching apparatus designer. Among them is the fact that the arc results in the undesirable flow of electrical current through the electrical switching apparatus to the load. Additionally, the arc, which extends between the contacts, often results in vaporization or sublimation of the contact material itself. Therefore, it is desirable to extinguish any such arcs as soon as possible upon their propagation.

To facilitate this process, some electrical switching apparatus include arc chute assemblies which are structured to attract and break-up the arcs. For example and without limitation, a number of movable contacts of the electrical switching apparatus are mounted on movable arms which pivot the movable contacts past or through arc chutes as they move into and out of electrical contact with corresponding stationary contacts. Each arc chute assembly includes a plurality of spaced apart arc plates mounted in a wrapper and/or coupled to the electrical switching apparatus housing. As the movable contact is moved away from the stationary contact, the movable contact moves past the ends of the arc plates, with the arc being magnetically drawn toward and between the arc plates. Arc chute assemblies and, in particular, the arc plates of the arc chute assemblies are designed to encourage the arc to enter the arc plates. For example, it has been known to provide the arc plates of the arc chute assembly with a throat geometry, such as a U-shape or V-shape, which is structured to attract the arc away from the separable contacts into the arc plates. Specifically, the U-shape or V-shape plate geometry results in the formation of an arc-induced magnetic field, which draws the arc into the arc chute assembly where it may be effectively split among the arc plates into a series of smaller arcs and dissipated until the electrical current of the arc is extinguished. Examples of arc chute assemblies and arc plates therefor are disclosed in U.S. Pat. Nos. 7,521,645; 7,094,986; and 7,034,242.

There is room for improvement in electrical switching apparatus, and in arc chute assemblies therefor.

SUMMARY

These needs and others are met by embodiments of the disclosed concept, which are directed to an arc chute assembly for an electrical switching apparatus, wherein the arc chute assembly includes a compact array of arc plates for enhanced arc splitting and retention.

As one aspect of the disclosed concept, an arc chute assembly is provided for an electrical switching apparatus. The electrical switching apparatus includes a housing and separable contacts enclosed by the housing. An arc is generated in response to the separable contacts being separated. The housing comprises a number of arc chambers each including a first side and a second side disposed opposite and spaced apart from the first side. The arc chute assembly comprises: a plurality of first arc plates structured to extend outwardly from the first side of a corresponding one of the arc chambers toward the second side of the corresponding one of the arc chambers; and a plurality of second arc plates structured to extend outwardly from the second side of the corresponding one of the arc chambers toward the first side of the corresponding one of the arc chambers. None of the first arc plates engage the opposing second side of the corresponding one of the arc chambers, and none of the second arc plates engage the opposing first side of the corresponding one of the arc chambers.

Each of the first arc plates and the second arc plates may comprise a first edge and a second edge disposed opposite the first edge. The first edge of each of the first arc plates may be structured to be coupled to the first side of the corresponding one of the arc chambers, and the first edge of each of the second arc plates may be structured to be coupled to the second side of the corresponding one of the arc chambers. The second edge of each of the first arc plates may be spaced apart from the second edge of a corresponding one of the second arc plates in the horizontal direction, thereby forming an air gap between the first arc plates and the second arc plates in the horizontal direction. The housing may further comprise a barrier element, and the arc chute assembly may be structured to receive at least a portion of the barrier element in the air gap between the first arc plates and the second arc plates.

The first arc plates may be offset with respect to the second arc plates. Each of the first arc plates and the second arc plates may comprise a top surface disposed in a first plane and a bottom surface disposed in a second plane, wherein the first plane of the top surface of each of the first arc plates is aligned with the second plane of the bottom surface of a corresponding one of the second arc plates.

As another aspect of the disclosed concept, an electrical switching apparatus comprises: a housing including a number of arc chambers, each of the arc chambers including a first side and a second side disposed opposite and spaced apart from the first side; separable contacts enclosed by the housing; at least one arc chute assembly disposed at or about the separable contacts within a corresponding one of the arc chambers in order to attract and dissipate an arc which is generated by the separable contacts being separated, the at least one arc chute assembly comprising: a plurality of first arc plates extending outwardly from the first side of a corresponding one of the arc chambers toward the second side of the corresponding one of the arc chambers, and a plurality of second arc plates extending outwardly from the second side of the corresponding one of the arc chambers toward the first side of the corresponding one of the arc chambers. None of the first arc plates engage the opposing second side of the corresponding one of the arc chambers, and none of the second arc plates engage the opposing first side of the corresponding one of the arc chambers.

BRIEF DESCRIPTION OF THE DRAWINGS

A full understanding of the disclosed concept can be gained from the following description of the preferred embodiments when read in conjunction with the accompanying drawings in which:

FIG. 4 is a back elevation view of a portion of an electrical switching apparatus and a plurality of arc chute assemblies therefor, in accordance with an embodiment of the disclosed concept;

FIG. 5 is a section view taken along line 5-5 of FIG. 4; and

FIG. 6 is an enlarged view showing the engagement between one of the arc plates of the arc chute assembly and the housing of the electrical switching apparatus of FIG. 5.

DESCRIPTION OF THE PREFERRED EMBODIMENTS

Figure 1:
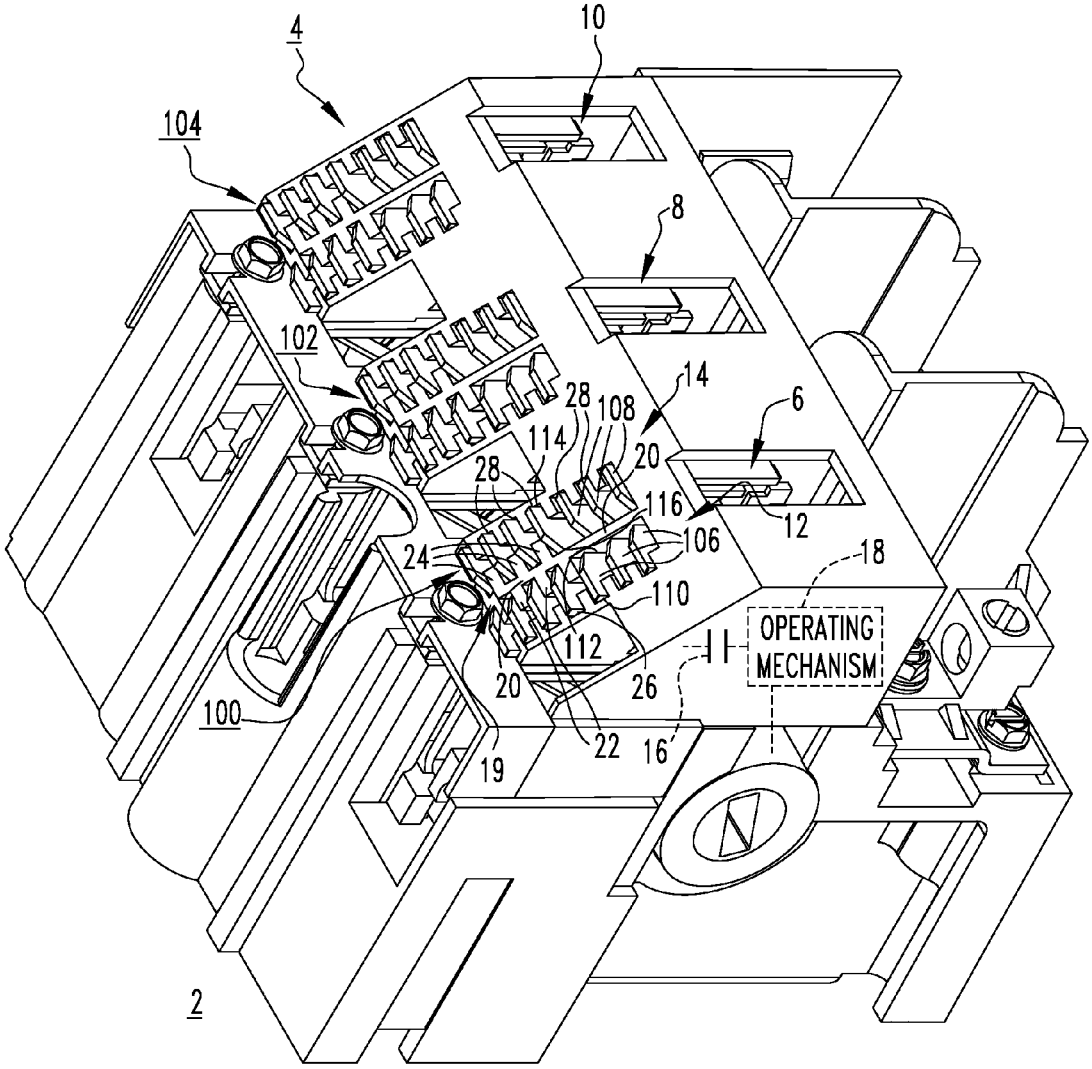
FIG. 1 is an isometric view of a portion of an electrical switching apparatus and arc chute assembly therefor, in accordance with an embodiment of the disclosed concept.

For purposes of illustration, embodiments of the disclosed concept will be described as applied to arc chute assemblies for a safety switch, although it will become apparent that they could also be applied to a wide variety of electrical switching apparatus (e.g., without limitation, circuit switching devices, such as switches with and without fuses, and other circuit interrupters, such as circuit breakers, contactors, motor starters, motor controllers and other load controllers) having an arc chute. For example and without limitation, the disclosed concept can be employed with switches having one or more sets of electrical contacts per pole, where the contacts can be arranged in series to increase the circuit load break voltage rating.

Directional phrases used herein, such as, for example, left, right, top, bottom, front, back, upper, lower and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an arc chute assembly 100 for an electrical switching apparatus such as, for example and without limitation, the safety switch 2, which is partially shown. The electrical switching apparatus 2 includes a housing 4 having a number of arc chambers 6,8,10 (also shown in FIGS. 4 and 5). It will be appreciated that, although the non-limiting example shown and described herein includes three arc chambers 6,8, 10, that any known or suitable alternative number and/or configuration of arc chambers (not shown) could be employed without departing from the scope of the disclosed concept. It will further be appreciated that for simplicity of illustration and economy of disclosure, only one of the arc chambers 6 and arc chute assemblies 100 therefor, will be shown and described in detail herein. The other arc chambers 8,10 and arc chute assemblies 102,104, respectively, thereof, are substantially similar in structure.

As shown in FIG. 1, and also FIGS. 4 and 5, the arc chamber 6 includes first and second opposing sides 12,14. Separable contacts 16 (shown in simplified form in hidden line drawing in FIG. 1) are enclosed by the housing 4. The electrical switching apparatus 2 may, although need not necessarily, include an operating mechanism 18 (shown in simplified form in hidden line drawing in FIG. 1) is structured to open and close the separable contacts 16 (FIG. 1) and, in the non-limiting example of a circuit breaker (not shown) can function to trip open (e.g., separate) the separable contacts 16 (FIG. 1) in response to an electrical fault. The aforementioned arc chute assembly 100 is disposed at or about the separable contacts 16 (FIG. 1) within a corresponding one of the arc chambers 6, in order to attract and dissipate an arc which is generated by the separable contacts 16 (FIG. 1) being separated.

The arc chute assembly 100 includes a plurality of first arc plates 106, which extend outwardly from the first side 12 of the arc chamber 6 toward the second side 14 thereof, and a plurality of second arc plates 108, which extend outwardly from the second side 14 of the arc chamber 6 toward the first side 12 thereof. None of the first arc plates 106 engage the opposing second side 14 of the arc chamber 6. Likewise, none of the second arc plates 108 engage the opposing first side 12 of the arc chamber 6.

Figure 2:
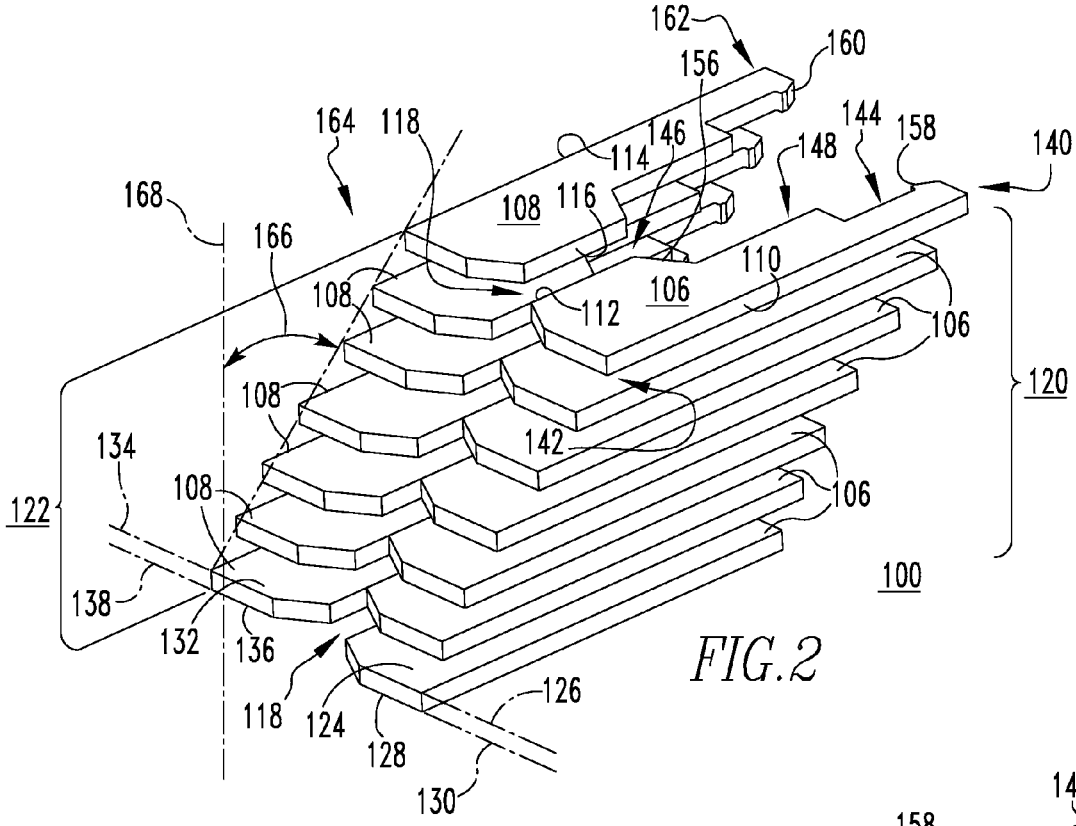
FIG. 2 is an isometric view of the arc chute assembly of FIG. 1.

More specifically, as best shown in FIG. 2, each of the first arc plates 106 of the arc chute assembly 100 includes a first edge 110 and a second edge 112 disposed opposite the first edge 110. The first edge 110 of each of the first arc plates 106 is coupled to the first side 12 of the arc chamber 6, as shown in FIGS. 1, 4 and 5. Likewise, the first edge 114 of each of the second arc plates 108 is coupled to the second side 14 of the arc chamber 6. The second edges 112,116 of the first and second arc plates 106,108, respectively, are spaced apart from one another in a horizontal direction, thereby forming an air gap 118 in the horizontal direction, as shown. Accordingly, it will be appreciated that the arc plates 106,108 of the example arc chute assembly 100 are preferably arc splitter plates, which each extend only a portion of the distance into the arc chamber 6, in order to form the aforementioned air gap 118. Such air gap 118 between the arc plates 106,108 advantageously generates an arc-induced magnetic field, which draws the arc column into the arc chute assembly 100 and, in particular, toward and into the air gap 118. In this manner, among other benefits, the disclosed arc chute assembly 100 enables increased arcing voltage for direct and alternating current circuit switching. In addition, the use of split arc plates 106,108 having the corresponding air gap 118, which divides the arc chute assembly 100, enables an increased number of arc plates 106,108 to be employed, thereby providing a compact design and further increasing the arcing voltage. In other words, a greater number of arc plates 106, 108 are available to attract and split (e.g., without limitation, divide and dissipate) the arc.

The first arc plates 106 of the example arc chute assembly 100 are also offset with respect to the second arc plates 108. For example and without limitation, as shown in FIGS. 2 and 4, each of the first arc plates 106 includes a top surface 124 disposed in a first plane 126, and a bottom surface 128 disposed in a second plane 130. Likewise, each of the second arc plates 108 includes a top surface 132 disposed in a first plane 134, and an opposing bottom surface 136 disposed in a second plane 138. The first plane 126 of the top surface 124 of each of the first arc plates 106 is preferably aligned with the second plane 138 of the bottom surface 136 of a corresponding one of the second arc plates 108, as best shown in FIG. 4. In other words, each of the second arc plates 108 is offset with respect to the corresponding first arc plates 106, a distance of about the height or thickness of one of the arc plates 106,108. This arrangement advantageously further enhances arc dissipation by providing additional room for additional splitter arc plates 106,108 than would otherwise be available if the arc plates were aligned (not shown). It also creates a zig-zag pathway of multiple arc plates 106,108 through which the arc must travel and, therefore, is dissipated.

Continuing to refer to FIG. 2, and also to FIGS. 3A and 3B, the preferred structure of the arc plates 106,108 (both shown in FIG. 2) will now be described in further detail. Preferably, although not necessarily, the first and second arc plates 106, 108 (both shown in FIG. 2) are substantially identical, resulting in the arc plates 106,108 being readily interchangeable and less expensive to manufacture. It will further be appreciated that, in view of the fact that the arc plates 106,108 are preferably substantially identical, only one of the arc plates 106 will be described in greater detail hereinbelow. Specifically, each of the arc plates 106 includes first and second opposing ends 140,142. The first end 140 is disposed proximate to the separable contacts 16 (shown in simplified form in hidden line drawing in FIG. 1) of the electrical switching apparatus 2 (FIG. 1).

Figure 3A:
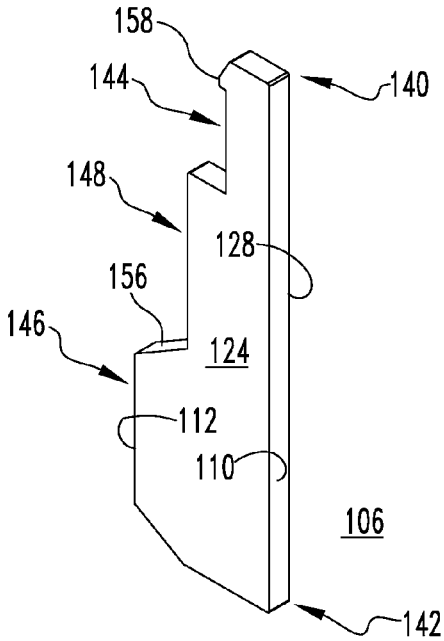
FIGS. 3A and 3B are isometric and top plan views, respectively, of an arc plate for the arc chute of FIG. 2.
Figure 3B:
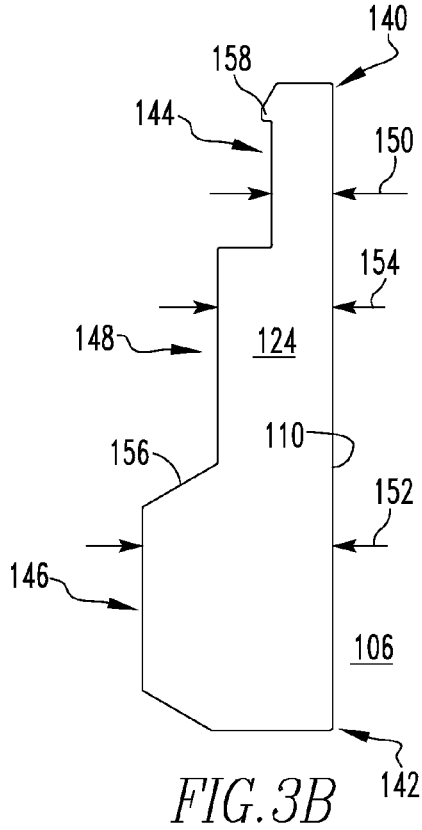

As shown in FIGS. 3A and 3B, the arc plate 106 includes a first section 144 disposed at or about the first end 140, a second section 146 disposed at or about the second end 142, and a third section 148 disposed between the first and second sections 144,146. Referring to FIG. 3B, the first section 144 has a first width 150, the second section 146 has a second width 152, and the third section 148 has a third width 144. As shown, the third width 144 of the third section 148 of the arc plate 106 is greater than the first width 150 of the first section 144, but is less than the second width 152 of the second section 146 of the arc plate 106. Preferably, the arc plate 106 further includes a tapered portion 156 extending between and interconnecting the second section 146 and the third section 148. It will be appreciated that such tapered portion 156 is structured to further attract the arc into the aforementioned air gap 118 (FIG. 2) between the arc plates 106,108 (both shown in FIG. 2), in accordance with the disclosed concept.

Continuing to refer to FIG. 2, the first arc plates 106 of the example arc chute assembly 100 are stacked one above another in a first spaced apart array 120, and the second arc plates 108 are stacked one above another in a second spaced apart array 122. In the example shown and described herein, the second ends 142 of the arc plates 106,108 are offset (e.g., without limitation, displaced backwards with respect to the underlying arc plate 106,108) with respect to one another. This results in the first and second ends 162,164 of the arrays 120,122 being disposed at an angle (see, for example and without limitation, angle 166 of second end 164 relative to the vertical axis 168 of FIG. 2). In other words, the arc chute assembly 100 is slanted backwards (from the perspective shown herein), as shown in FIGS. 1, 2 and 5.

Referring again to FIG. 1, and also to FIGS. 4 and 5, in order to ensure that the arc does not undesirably exit the arc chamber 6 of the electrical switching apparatus housing 4 at the second ends 142 (FIGS. 2, 3A and 3B) of the arc plates 106,108, the housing 4 preferably further includes a barrier element 19 (partially shown in section in FIG. 5). The example barrier element 18 includes a vertical segment 20 disposed within the air gap 118 between the second edges 112,116 of the first and second arc plates 106,108, respectively, and a plurality of horizontal segments 22,24. Some of the horizontal segments 22 extend laterally outwardly (e.g., to the right from the perspective of FIG. 1; to the left from the perspective of FIGS. 4 and 5) to be disposed between corresponding pairs of the first arc plates 106, whereas the remaining horizontal segments 24 extend laterally outwardly (e.g., to the left from the perspective of FIG. 1; to the right from the perspective of FIGS. 4 and 5) from the opposite side of the vertical segment 20 to be disposed between corresponding pairs of the second arc plates 108, as shown. In this manner, the barrier element 19 and, in particular, the vertical segment 20 and horizontal segments 22,24 thereof function to maintain the arc within the desired position in the air gap 118 between the arc plates 106,108. In one non-limiting example, the vertical segment 20 of the barrier element 19 extends into the air gap 118 about ⅛ inch, although it will be appreciated that any known or suitable alternative type and/or configuration of barrier element (not shown) could be employed, without departing from the scope of the disclosed concept.

Also shown in FIGS. 1, 4 and 5, is the fact that the first edges 110,114 of the first and second arc plates 106,108 are respectively disposed in first and second recesses (e.g., without limitation, elongated slots) in the first and second sides 12,14 of the arc chamber 6. In this manner, the arc plates 106,108 are maintained in the desired position. The desired position of the arc plates 106,108 within the example arc chute assembly 100 is further maintained by the fact that the arc plates 106,108 preferably include protrusions 158,160 (both shown in FIG. 2) structured to fixedly engage corresponding projections 30,32 (both shown in FIG. 5), respectively, of the electrical switching apparatus housing 4.

As shown in FIG. 5, the projections 30,32 of the example housing 4 are a first molded projection 30 disposed opposite and spaced apart from the first side 12 of the arc chamber 6, and a second molded projection 32 disposed opposite and spaced apart from the first side 14 of the arc chamber 6. As shown with reference to arc plate 106 (shown in section view) in FIGS. 5 and 6, when the arc plate 106 is in the desired position, the aforementioned first section 144 (FIGS. 2-3B) of the arc plate 106 is disposed between the first wall 12 and the first molded projection 30. Preferably, the interaction between the arc plate 106 and the molded projection 30 provides a press fit or interference fit among the components. In any event, the example protrusion is a barb 158, which extends outwardly from arc plate 106 to securely engage the corresponding molded projection 32 of the housing 4, to further maintain the position of the arc plate 106 within the arc chute assembly 100. It will be appreciated that the second arc plates 108 are secured with respect to the second side 114 of the arc chamber 6 in substantially the same manner.

Accordingly, the disclosed arc chute assembly 100 (FIGS. 1, 2 and 4-6), 102,104 (FIGS. 1, 4 and 5) provides a unique arrangement of arc plates 106,108, wherein the arc plates 106,108 are preferably stacked in compact arrays 120,122, respectively, and provide an air gap 118 and an offset (e.g., without limitation, vertically staggered) arrangement to enhance arc attraction and dissipation (e.g., without limitation, arc splitting).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc chute assembly for an electrical switching apparatus including a housing and separable contacts enclosed by said housing, an arc being generated in response to said separable contacts being separated, said housing comprising a number of arc chambers each including a first side and a second side disposed opposite and spaced apart from the first side, said arc chute assembly comprising:

a plurality of first arc plates structured to extend outwardly from the first side of a corresponding one of said arc chambers toward the second side of said corresponding one of said arc chambers; and a plurality of second arc plates structured to extend outwardly from the second side of said corresponding one of said arc chambers toward the first side of said corresponding one of said arc chambers, wherein none of said first arc plates engage the opposing second side of said corresponding one of said arc chambers, and wherein none of said second arc plates engage the opposing first side of said corresponding one of said arc chambers, wherein each of said first arc plates and said second arc plates comprises a first edge and a second edge disposed opposite the first edge; wherein the first edge of each of said first arc plates is structured to be coupled to the first side of said corresponding one of said arc chambers; wherein the first edge of each of said second arc plates is structured to be coupled to the second side of said corresponding one of said arc chambers; and wherein the second edge of each of said first arc plates is spaced apart from the second edge of a corresponding one of said second arc plates in the horizontal direction, thereby forming an air gap between said first arc plates and said second arc plates in the horizontal direction, wherein said housing further comprises a barrier element; and wherein said arc chute assembly is structured to receive at least a portion of said barrier element in the air gap between said first arc plates and said second arc plates.

2. The arc chute assembly of claim 1 wherein said first arc plates are offset with respect to said second arc plates.

3. The arc chute assembly of claim 2 wherein each of said first arc plates and said second arc plates comprises a top surface disposed in a first plane and a bottom surface disposed in a second plane; and wherein the first plane of the top surface of each of said first arc plates is aligned with the second plane of the bottom surface of a corresponding one of said second arc plates.

4. The arc chute assembly of claim 1 wherein said first arc plates and said second arc plates are substantially identical.

5. The arc chute assembly of claim 1 wherein each of said first arc plates and said second arc plates comprise a first end structured to be disposed proximate said separable contacts of said electrical switching apparatus, a second end disposed opposite and distal from the first end, a first section disposed at or about the first end, a second section disposed at or about the second end, and a third section disposed between the first section and the second section; wherein the first section has a first width; wherein the second section has a second width; wherein the third section has a third width; and wherein the third width of the third section is greater than the first width of the first section and less than the second width of the second section.

6. The arc chute assembly of claim 5 wherein each of said first arc plates and said second arc plates further comprises a tapered portion extending between the second section and the third section.

7. The arc chute assembly of claim 5 wherein the first end of each of said first arc plates and the first end of each of said second arc plates includes a protrusion; and wherein said protrusion is structured to fixedly engage a portion of said housing of said electrical switching apparatus.

8. An arc chute assembly for an electrical switching apparatus including a housing and separable contacts enclosed by said housing, an arc being generated in response to said separable contacts being separated, said housing comprising a number of arc chambers each including a first side and a second side disposed opposite and spaced apart from the first side, said arc chute assembly comprising:

a plurality of first arc plates structured to extend outwardly from the first side of a corresponding one of said arc chambers toward the second side of said corresponding one of said arc chambers; and a plurality of second arc plates structured to extend outwardly from the second side of said corresponding one of said arc chambers toward the first side of said corresponding one of said arc chambers, wherein none of said first arc plates engage the opposing second side of said corresponding one of said arc chambers, and wherein none of said second arc plates engage the opposing first side of said corresponding one of said arc chambers, wherein said first arc plates are stacked one above another in a first spaced apart array; wherein said second arc plates are stacked one above another in a second spaced apart array; wherein each of said first spaced apart array and said second spaced apart array includes a first end and a second end; wherein the second ends of said first arc plates are offset with respect to one another in order that the second end of said first spaced apart array is disposed at an angle; and wherein the second ends of said second arc plates are offset with respect to one another in order that the second end of said second spaced apart array is disposed at an angle.

9. An electrical switching apparatus comprising:

a housing including a number of arc chambers, each of said arc chambers including a first side and a second side disposed opposite and spaced apart from the first side;

separable contacts enclosed by said housing;

at least one arc chute assembly disposed at or about said separable contacts within a corresponding one of said arc chambers in order to attract and dissipate an arc which is generated by said separable contacts being separated, said at least one arc chute assembly comprising:

a plurality of first arc plates extending outwardly from the first side of a corresponding one of said arc chambers toward the second side of said corresponding one of said arc chambers, and a plurality of second arc plates extending outwardly from the second side of said corresponding one of said arc chambers toward the first side of said corresponding one of said arc chambers, wherein none of said first arc plates engage the opposing second side of said corresponding one of said arc chambers, and wherein none of said second arc plates engage the opposing first side of said corresponding one of said arc chambers, wherein each of said first arc plates of said at least one arc chute assembly and said second arc plates of said at least one arc chute assembly comprises a first edge and a second edge disposed opposite the first edge; wherein the first edge of each of said first arc plates is coupled to the first side of said corresponding one of said arc chambers; wherein the first edge of each of said second arc plates is coupled to the second side of said corresponding one of said arc chambers; and wherein the second edge of each of said first arc plates is spaced apart from the second edge of a corresponding one of said second arc plates in the horizontal direction, thereby forming an air gap between said first arc plates and said second arc plates in the horizontal direction, and wherein said housing further comprises a barrier element; wherein said first arc plates of said at least one arc chute assembly are stacked one above another in a first spaced apart array; wherein said second arc plates of said at least one arc chute assembly are stacked one above another in a second spaced apart array; wherein said barrier element includes a vertical segment and a plurality of horizontal segments extending laterally outwardly from said vertical segment; wherein said vertical segment is disposed within said air gap between said first arc plates and said second arc plates; and wherein each of said horizontal segments is disposed between one of a corresponding pair of said first arc plates and a corresponding pair of said second arc plates.

10. The electrical switching apparatus of claim 9 wherein the first side of each of said arc chambers of said housing includes a plurality of first recesses; wherein the second side of each of said arc chambers includes a plurality of second recesses; wherein the first edge of each of said first arc plates is disposed within a corresponding one of said first recesses; and wherein the first edge of each of said second arc plates is disposed within a corresponding one of said second recesses.

11. The electrical switching apparatus of claim 9 wherein said first arc plates of said at least one arc chute assembly are offset with respect to said second arc plates of said at least one arc chute assembly.

12. The electrical switching apparatus of claim 11 wherein each of said first arc plates and said second arc plates comprises a top surface disposed in a first plane and a bottom surface disposed in a second plane; and wherein the first plane of the top surface of each of said first arc plates is aligned with the second plane of the bottom surface of a corresponding one of said second arc plates.

13. The electrical switching apparatus of claim 9 wherein each of said first arc plates of said at least one arc chute assembly and said second arc plates of said at least one arc chute assembly comprise a first end disposed proximate said separable contacts of said electrical switching apparatus, a second end disposed opposite and distal from the first end, a first section disposed at or about the first end, a second section disposed at or about the second end, and a third section disposed between the first section and the second section; wherein the first section has a first width; wherein the second section has a second width; wherein the third section has a third width; and wherein the third width of the third section is greater than the first width of the first section and less than the second width of the second section.

14. The electrical switching apparatus of claim 9 wherein each of said first arc plates of said at least one arc chute assembly and said second arc plates of said at least one arc chute assembly comprise a protrusion; wherein said housing further comprises a number of projections; and wherein said protrusion fixedly engages a corresponding one of said projections of said housing.

15. The electrical switching apparatus of claim 14 wherein said projections are a first molded projection disposed opposite and spaced apart from the first side of a corresponding one of said arc chambers and a second molded projection disposed opposite and spaced apart from the second side of said corresponding one of said arc chambers of said housing; wherein a portion of each of said first arc plates is disposed between the first wall and said first molded projection; wherein a portion of each of said second arc plates is disposed between the second wall and said second molded projection; wherein said protrusion comprises a barb; and wherein each barb engages a corresponding one of said first molded projection and said second molded projection in order to maintain the position of said first arc plates and said second arc plates within said at least one arc chute assembly.

16. The electrical switching apparatus of claim 9 wherein said number of arc chambers is a plurality of arc chambers; wherein said at least one arc chute assembly is a plurality of arc chute assemblies; and wherein each of said arc chute assemblies is disposed within a corresponding one of said arc chambers.

* * * * *